US005728416A

United States Patent [19]

Bono et al.

[11] Patent Number: 5,728,416

[45] Date of Patent: Mar. 17, 1998

[54] CONTAINER FOR HEATING FROZEN FRENCH FRIES IN A TOASTER

[75] Inventors: James L. Bono, Cincinnati; Lewis A. Tucker, Fairfield; Deborah J. Yee, Cincinnati, all of Ohio

[73] Assignee: The Procter & Gamble Company, Cincinnati, Ohio

[21] Appl. No.: 668,487

[22] Filed: Jun. 21, 1996

[51] Int. Cl.[6] ..... B65D 81/34

[52] U.S. Cl. ..... 426/113; 426/110; 426/107; 426/124

[58] Field of Search ..... 426/113, 107, 426/412, 124, 110

[56] References Cited

U.S. PATENT DOCUMENTS

| | | | |
|---|---|---|---|
| 2,838,404 | 6/1958 | Cohen | 426/113 |
| 2,881,078 | 4/1959 | Oritt | 426/107 |
| 2,912,336 | 11/1959 | Perino | 426/107 |
| 3,117,875 | 1/1964 | Burns et al. | 426/113 |
| 3,185,372 | 5/1965 | Ferraro | 426/107 |
| 3,361,576 | 1/1968 | Jacobson | 426/107 |
| 3,392,033 | 7/1968 | Thulin | 426/113 |
| 3,410,700 | 11/1968 | Gstohl . | |
| 3,424,596 | 1/1969 | Sullivan | 426/113 |
| 3,442,662 | 5/1969 | Robinson | 426/107 |
| 3,446,632 | 5/1969 | Le Van . | |
| 3,469,998 | 9/1969 | Lane . | |
| 3,554,770 | 1/1971 | Lipsky et al. | 426/107 |
| 3,585,048 | 6/1971 | Uhlig et al. . | |
| 3,597,238 | 8/1971 | Scharre . | |
| 3,615,706 | 10/1971 | Robinson . | |
| 3,615,711 | 10/1971 | Markus et al. . | |
| 3,633,239 | 1/1972 | Rowe et al. . | |
| 3,672,916 | 6/1972 | Virnig | 426/113 |
| 3,728,957 | 4/1973 | Polus | 426/523 |
| 3,741,778 | 6/1973 | Rowe . | |
| 3,759,721 | 9/1973 | Hawley . | |
| 3,831,508 | 8/1974 | Wallard | 426/113 |
| 3,836,064 | 9/1974 | Stillwagon | 229/3.5 MF |
| 3,873,735 | 3/1975 | Chalin et al. | 426/113 |
| 3,891,775 | 6/1975 | Murray et al. | 426/107 |
| 4,051,266 | 9/1977 | Goltsos | 426/120 |
| 4,135,004 | 1/1979 | Finkel | 426/637 |
| 4,238,517 | 12/1980 | Bosley et al. | 426/637 |
| 4,522,953 | 6/1985 | Barby et al. | 521/64 |
| 4,603,052 | 7/1986 | El-Hag et al. | 426/113 |
| 5,034,234 | 7/1991 | Andreas et al. | 426/113 |
| 5,073,390 | 12/1991 | Knight et al. | 426/113 |
| 5,096,723 | 3/1992 | Turpin | 426/113 |
| 5,260,345 | 11/1993 | Desmarais et al. | 521/148 |

FOREIGN PATENT DOCUMENTS

| | | | |
|---|---|---|---|
| 797651 | 10/1968 | Canada | 220/43.5 |
| 797652 | 10/1968 | Canada | 220/43.5 |
| 869865 | 5/1971 | Canada | 217/38 |
| 1158988 | 7/1969 | United Kingdom . | |

*Primary Examiner*—Steven Weinstein
*Attorney, Agent, or Firm*—Ronald W. Kock

[57] ABSTRACT

A container for heating frozen French fries in a toaster. The frozen French fries preferably have a moisture content by weight ranging from 35% to 55% prior to heating in the toaster. The container comprises an upright structure adapted to removably fit into a vertical slot of a conventional toaster and be supported by the toaster during a toaster heating cycle. The upright structure has a front and back connected to a closed bottom. The front and back have side edges and apertures through the front and back for passing heat from the toaster to frozen French fries located inside the container and for passing steam from heated French fries to outside of the container. The container has an openable end to permit removal of the French fries after heating. The closed bottom forms a drip trough for collecting drippings from the French fries. The container also has a means for protecting ends of the French fries from direct exposure to the radiant heat from the toaster so that the ends of the French fries are not burned.

8 Claims, 2 Drawing Sheets

CONTAINER FOR HEATING FROZEN FRENCH FRIES IN A TOASTER

FIELD OF THE INVENTION

The present invention relates to containers for supporting articles heated in a toaster, and more particularly to such containers wherein a plurality of frozen French fries are simultaneously heated.

BACKGROUND OF THE INVENTION

French fries are one of the most popular convenience foods. A wide variety of French fried potato products are produced for both foodservice and home use. French fried potato strips, commonly referred to as "French fries" are served in most fast food restaurants. Many restaurants and consumers prefer to prepare the French fries from the frozen or chilled partially fried strips (hereinafter par-fried) rather than go through the procedure of preparing French fries directly from raw potatoes.

The use of par-fries potato strips has been widely adopted because of the advantages they offer. A few of the recognized advantages associated with the use of frozen par-fried potato strips are, for example, users know the exact cost, the number of servings and the cost per portion. In addition, use of the frozen par-fried potatoes simplifies storage and inventory control, assures uniform quality from one season to another and reduces labor and time preparation for serving.

A major problem confronted by consumers when reheating frozen par-fried potato strips is obtaining the preferred taste and texture of French fries that are finished by frying in hot oil. Important features of French fries finished by deep frying are interior moistness and crispness of the crust. Re-heated frozen fries are typically leathery, tough, drier and less lubricious than French fries finished by frying in hot oil. Alternatively, they tend to be limp and soggy and do not have a crisp crust.

Reheating frozen French fries is usually accomplished in a forced air convection oven, a hot air impingement oven, a combination of infrared radiation and convection oven, a toaster oven, a combined microwave and convection oven, or a conventional home oven. A conventional toaster, with multiple upright slots and pairs of upright radiant heaters located at either side of each toaster slot, provides rapid heating of French fries faster than in an ordinary oven, presumably because of the closer proximity of the heating elements to both sides of the French fries. However, conventional toasters are not known to have been used to heat frozen French fries because of the difficulty handling a plurality of fries in a narrow upright slot and because of the significant amount of oil drippings released from reheated fries. The significant oil is a result of a process of "enrobing" the par-fried potato strips in oil prior to freezing them, so that a deep fried flavor is obtained upon reheating.

Although initially intended for toasting bread, toasters are now used to heat waffles and other frozen food articles. Typically, one article is placed in each toaster slot. Prior art U.S. Pat. No. 3,410,700 to Gstohl teaches the placement of disposable foil packages containing frozen pizza into toaster slots. Such packages have perforations to enable radiant heat to enter and steam to exit. However, packages in the art are deficient in terms of their ability to absorb drippings from food articles which contain oils or other fluids which do not readily vaporize upon heating in a toaster. Also, packages in the art typically do not have a plurality of side-by-side frozen food articles in the same container, wherein article orientation in the container may influence heating.

Space is limited in a toaster slot, but a toaster package holds a reasonably sized serving of French fries, even when the fries are stacked vertically, side-by-side, one layer deep in the container. Stacking French fries side-by-side with a vertical orientation promotes oil drippings from the fries to flow evenly over the fries to the bottom of the container. Potato strips are typically cut having tapered ends. Such strips are sliced axially from raw potatoes and have a rectangular cross-section and tapered ends. The tapered ends result from the curvature of the potato, where the end of the strip corresponds to the curved surface of the potato. The tapered ends tend to become burned during toaster heating unless they are protected from direct radiation from toaster heating elements, which are often heated at about 600° F. Such protection is not taught in the art.

When handling toaster containers for frozen food articles such as French fries, the user may be involved in loading the articles into the container, removing the heated container from the toaster, and removing the articles from the heated container. If the container is designed to be disposable, the user typically isn't concerned with stacking articles into the container. However, in either a disposable container or a reusable container situation, the user is faced with manipulating a heated container. There is also a concern for avoiding electrical shock from a faulty toaster if the container is electrically conductive. Although the art suggests complicated handle mechanisms, what is missing is a simple means for manipulating the container which is either integral to the container material or which serves merely as a lifting tab.

OBJECTS OF THE INVENTION

It is an object of the present invention to provide toaster heated frozen par-fried potato strips, comprising about 35% to about 55% moisture when frozen, that have substantially the same internal and surface texture as deep fried French fries after reheating.

It is another object of the present invention to provide a means for protecting the tapered ends of French fries from being burned by direct exposure to radiation during toaster heating.

It is still another object of the present invention to provide a container for reheating French fries in a toaster, which has apertures sized for sufficient open area but also sized to prevent French fries escaping from the container.

SUMMARY OF THE INVENTION

In one aspect of the present invention, a container for heating frozen French fries in a toaster comprises an upright structure adapted to removably fit into a vertical slot of a conventional toaster and be supported by the toaster during a toaster heating cycle. The upright structure has a front and back connected to a closed bottom. The front and back have side edges and apertures through the front and back for passing heat from the toaster to the frozen French fries located inside the container and for passing steam from heated French fries to outside of the container. The container has an openable end to permit removal of the French fries after heating. The closed bottom forms a drip trough for collecting drippings from the French fries.

The frozen French fries are preferably oriented substantially upright in the upright structure. The container may further comprise a solid band of material above the apertures in the from and the back of the container for protecting uppermost ends of the French fries from direct exposure to radiant heat from the toaster so that the uppermost ends are not burned.

The upright structure may be substantially rigid in order to be reusable in the toaster, such that additional batches of the frozen French fries are manually loadable into the openable end after heated French fries are removed therefrom. Alternatively, the upright structure may be made of thin metal foil, or other toaster compatible film, to serve as a disposable package for storage of the frozen French fries as well as for support in the toaster.

The frozen French fries preferably have a moisture content ranging from 35% to 55% by weight prior to being heated in the toaster.

The apertures provide an open area in the front and said back between the solid band of material and the drip trough, which ranges from about 50% to about 75%. However, the apertures are sized small enough that the frozen French fries and the heated French fries cannot escape from the container through the apertures.

BRIEF DESCRIPTION OF THE DRAWINGS

While the specification concludes with claims which particularly point out and distinctly claim the present invention, it is believed that the present invention will be better understood from the following description of preferred embodiments, taken in conjunction with the accompanying drawings, in which like reference numerals identify identical elements and wherein:

DETAILED DESCRIPTION OF THE INVENTION

Figure 1:
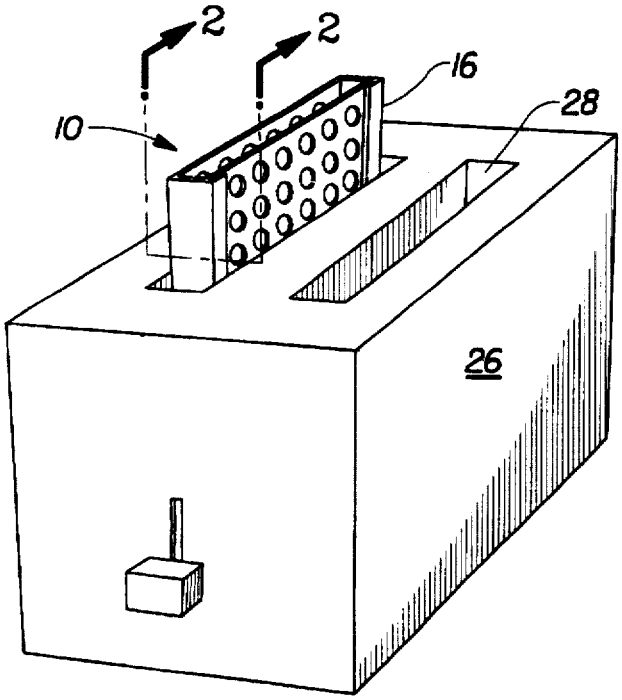
FIG. 1 is perspective view of a toaster and a preferred embodiment of the present invention, showing a container for heating frozen French Fries with its top portion extending from the toaster slot.
Figure 2:
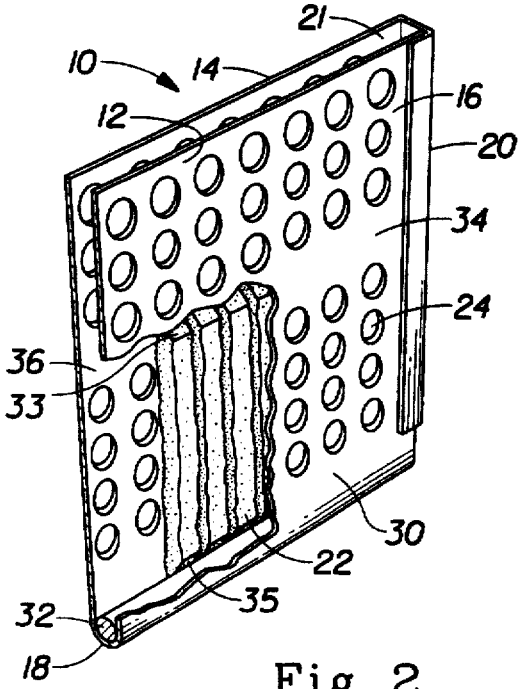
FIG. 2 is a sectioned perspective view of the container of FIG. 1, taken along section line 2—2 of FIG. 1, showing apertures in both front and back of an upright container structure having folded side edges, an open top, a closed bottom, a fluid-absorbing member at the dosed bottom, and French fries resting atop the fluid-absorbing member.

Referring now to the drawings, and more particularly to FIGS. 1 and 2, there is shown a first preferred embodiment of the present invention, which provides a container for heating frozen French fries in a toaster, and is generally indicated as 10. Container 10 has an upright structure comprising a front 12, a back 14, a top portion 16, a closed bottom 18, and side edges 20. Top portion 16 has an openable top end 21, which may be closable or always open. Container 10 is designed to hold a plurality of frozen French fries 22 one layer deep between front 12 and back 14.

Front 12 and back 14 both have apertures 24 therethrough for the purpose of allowing radiant heat from a conventional toaster into container 10 to heat frozen French fries 22. A conventional toaster 26 typically has one or more upright slots 28 into which are placed items to be heated. At either side of each slot is a heating element (not shown) which may be heated to about 600° F. At this temperature, infrared radiation is directed from the heating elements toward the item resting in each slot. The heating elements do not contact the items in the slots; therefore, radiation is believed to be the primary means of heat transfer. Heating continues for several minutes or until a sensor detects the desired temperature or discoloration of the heated item. The user generally is required to lift the heated item out of the toaster slot after the heat cycle is completed.

Apertures 24 preferably have an open area which enables heat to enter at a rate which properly heats the French fries. Different food article sizes, shapes, and moisture content, for example, may require different aperture open areas to regulate heating rate. For French fries of the type disclosed in copending application, Ser. No. 08/639,820, entitled "PROCESS FOR PREPARING FROZEN PAR-FRIED POTATO STRIPS HAVING DEEP FRIED TEXTURE WHEN OVEN FINISHED", filed on Apr. 29, 1996, and assigned to the assignee of the present application, which is hereby incorporated by reference, the preferred open area ranges from 50% to 75%. Apertures 24 also enable steam generated during the heating of frozen French fries 22 to escape from the food articles to outside of container 10. Apertures 24 are preferably round and 9.5 mm in diameter and are placed in horizontal rows. Any pattern or shape of apertures may be used to provide the desired open area. However, it is preferable that aperture size be limited to a size smaller than that which will allow either frozen or heated French fries to escape from the container through such apertures.

Container 10 may be made substantially rigid from metal as a reusable holder for a plurality of frozen French fries, or it may be made from thin flexible metal foil such that it is disposable. If reusable, top portion 16 preferably has a permanently open end 21 for loading and unloading French fries. If disposable, top portion 16 may have either a permanently open end 21 or a closable end which is openable or partially openable for venting while containing French fries. For example, top portion 16 could be foldable downward against front 12 and even sealed thereto for storage of frozen French fries 22.

Top portion 16 preferably extends well above the vertical slot of a conventional toaster so that the extended portion is cool-to-the-touch during and after heating in the toaster. The apertures in the thin metal foil provide limited conduction paths for heat between apertures and convection paths for air to cool the foil. Having a cool-to-the-touch portion enables the user to safely lift the heated package and contents out of the toaster by his or her fingers. Utilizing the apertured top portion of the container for cool-to-the-touch handling eliminates the need for add-on handles or other more expensive solutions. For cool-to-the-touch effectiveness, the top portion preferably extends 25 mm to 50 mm above the toaster slot when the container is fully inserted into the slot.

Figure 6:
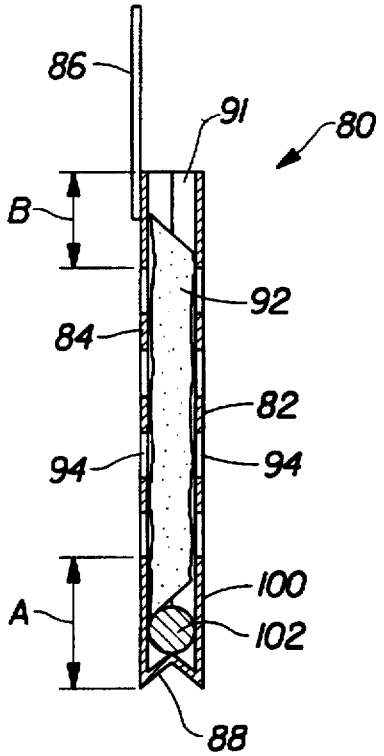
FIG. 6 is a sectioned side elevation view thereof, taken along section line 6—6 of FIG. 5, showing non-apertured portions C and D located at the ends of French fries inside the container, and a non-electrically conductive lifting tab attached to the container.
Figure 5:
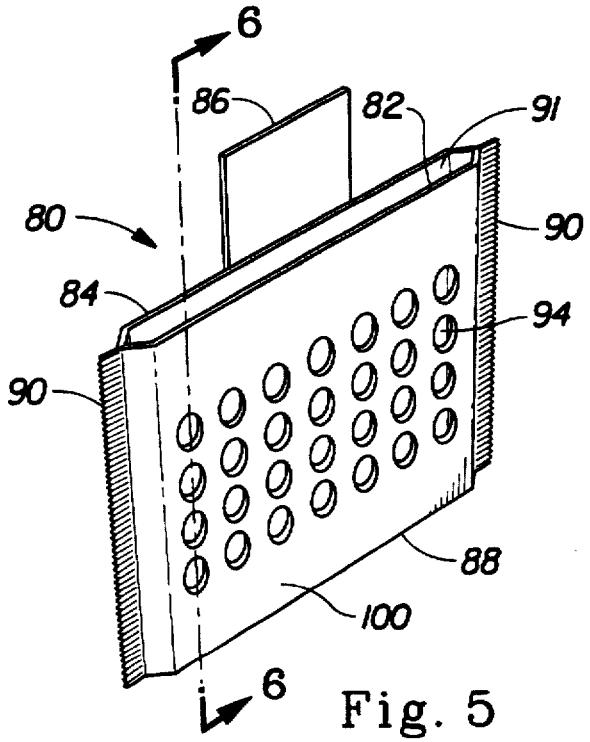
FIG. 5 is a perspective view of another alternative embodiment of the present invention, showing the container for heating frozen French fries.

A defective toaster may enable a current to pass through container 10 from toaster 26 and thereby potentially cause an electrical shock. Although such occurrence could be expected to be extremely rare based on known toaster safety records, top portion 16, and indeed entire container 10, may be coated externally with an electrically non-conductive material, such as silicon dioxide. Alternatively, as shown in FIGS. 5 and 6, an electrically non-conductive paper lifting tab may be attached to the container in place of top portion 16 in order to reduce container material as well as to reduce the potential for electrical shock.

Figure 3:
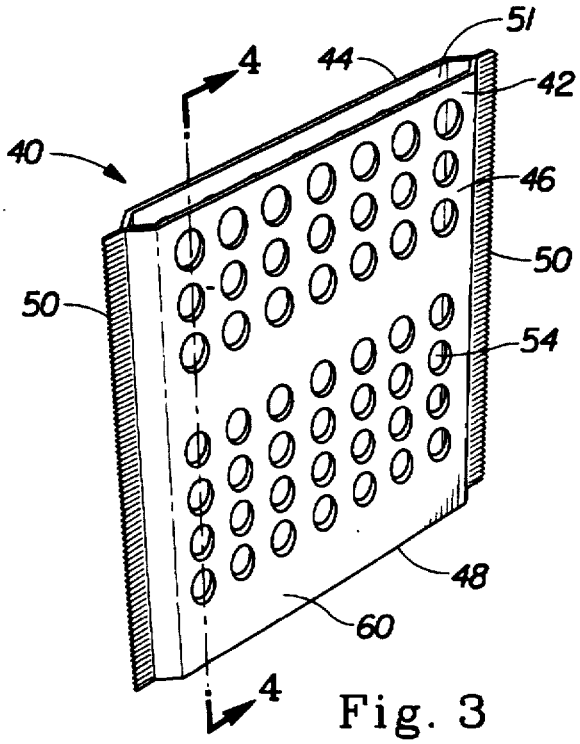
FIG. 3 is a perspective view of an alternative embodiment of the present invention, showing the container for heating frozen French fries.

Side edges 20 of container 10 have no adhesive holding them together because adhesive may melt or otherwise contaminate French fries inside the container during heating. Instead, side edges 20 of front 12 and back 14 are held together for example, by folding the front or the back side edges into a lap joint or by folding abutted edges 180° together in one direction, or by other commonly known folding techniques. Once folded, the foil holds its folded condition and thereby maintains the side edges closed. Alternatively, for thin metal foil, a preferred means of joining side edges is to crimp abutted side edges as shown in FIG. 3. Still other mechanical fastening techniques may be used, such as perforating abutted side edges, spot welding them together, or combinations of these techniques. It is preferred that the mechanical fastening technique have adequate strength to withstand handling and heating but be weak enough that side edges are openable to ease the removal of heated French fries from the container after heating is completed. Preferably, the thin metal foil is aluminum foil 1 mils to 4 mils thick.

Closed bottom 18 of container 10 is preferably folded so that container 10 may be made of a single sheet of material; however, closed bottom 18 may be joined similarly to side edges if front and back are two different sheets of material. The fold depends on the type of side edge seam used. For example, in FIG. 2, a rounded bottom or single crease fold is used when side edges are folded in an overlap fashion. However, in FIG. 3, multiple bottom folds may be used when side edges are abutted and then joined. The closed bottom is designed to accommodate the thickness of the single layer of French fries placed in the container.

For French fries, which contain fluids in addition to water, such as oil, heating causes fluids to drip from the French fries. Closed bottom 18 preferably forms a drip trough 30 into which the drippings may accumulate. Located in drip trough 30 of closed bottom 18 is preferably a fluid-absorbent member 32, which is made of a material which will absorb drippings while supporting French fries 22 so that drippings are effectively separated from the French fries. Fluidabsorbent member 32 may be fixedly attached into drip trough 30 or it may be removable therefrom so that a replacement member 32 may be used in a reusable container. In the disposable container, fluid-absorbing member 32 is preferably fixedly attached by mechanically crimping drip trough 30 part way around it or by adhesively bonding member 32 to the bottom of drip trough 30. Adhesive used below the level of the toaster heating elements remains relatively cool during food article heating.

When French fries are heated in a toaster, the uppermost ends 33 and lowermost ends 35 of the French fries may be burned because they are typically tapered and therefore have less mass and greater surface areas at their ends, which enables the ends to heat faster than the bodies of the French fries. To avoid burning, the ends, of the French fries are preferably protected from exposure to direct radiation from toaster heating elements. This protection is accomplished by providing front 12 and back 14 with non-apertured zones at the elevation of the tapered ends of the French fries. At the uppermost ends 33 of French fries 22, a solid band of material 34 in front 12 and a solid band of material 36 in back 14 serve to shield direct radiation from the heating elements. At lowermost ends 35 of French fries 22, drip trough 32 is provided a depth without apertures, which similarly shields lowermost ends 35 from the direct radiation of the heating elements. Preferably, apertures are located a distance A from the bottom edge of the container and the solid band has a width B, as shown in FIG. 4.

Figure 4:
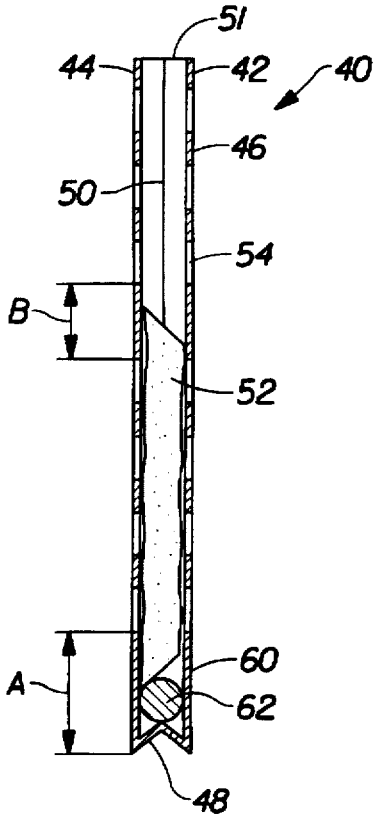
FIG. 4 is a sectioned side elevation view thereof, taken along section line 4—4 of FIG. 3, showing non-apertured portions A and B located at the ends of French fries inside the container.

FIGS. 3 and 4 show an alternative embodiment of the container for heating frozen French fries in a toaster, which is essentially the same as the embodiment of FIGS. 1 and 2, except that the side edges are shown crimped closed instead of folded. A container generally indicated as 40 has an upright structure comprising a front 42, a back 44, a top portion 46, a closed bottom 48, and side edges 50. Top portion 46 has an openable top end 51, which may be closable or always open. Container 40 is designed to hold a plurality of frozen French fries 52 one layer deep between front 42 and back 44.

Front 42 and back 44 both have apertures 54 therethrough for the purpose of allowing radiant heat from a conventional toaster into container 40 to heat frozen French fries 52. Apertures 54 preferably have an open area which enables heat to enter at a rate which properly heats the French fries. Apertures 54 are preferably round and 9.5 mm in diameter and are placed in a nested pattern. Any pattern or shape of apertures may be used to provide the desired open area.

Since container 40 is preferably made of thin flexible foil, top portion 46 may have either a permanently open end 51 or a dosable end which is openable. For example, top portion 46 could be foldable downward against front 42 and even sealed thereto for storage of frozen French fries 52. Top portion 46 preferably extends well above the vertical slot of a conventional toaster so that the extended portion is cool-to-the-touch during and after heating in the toaster.

Closed bottom 48 of container 40 is preferably folded so that container 40 may be made of a single sheet of material and yet accommodate the thickness of the single layer of French fries placed in the container. Closed bottom 48 preferably forms a drip trough 60 into which the drippings may accumulate. Located in drip trough 60 of dosed bottom 48 is preferably a fluid-absorbent member 62, which is made of a material which will absorb drippings while supporting French fries 52 so that drippings are effectively separated from the French fries.

FIGS. 5 and 6 show another alternative embodiment of the container for heating frozen French fries in a toaster, which is essentially the same as the embodiment of FIGS. 3 and 4, except that the top portion, which extends above the toaster, is replaced by a non-electrically conductive lifting tab. A container generally indicated as 80 has an upright structure comprising a front 82, a back 84, a lifting tab 86, a closed bottom 88, and side edges 90. Opposite closed bottom 88 is an openable top end 91, which may be closable or always open. Container 80 is designed to hold a plurality of frozen French fries 92 one layer deep between front 82 and back 84.

Front 82 and back 84 both have apertures 94 therethrough for the purpose of allowing radiant heat from a conventional toaster into container 80 to heat frozen French fries 92. Apertures 94 preferably have an open area which enables heat to enter at a rate which properly heats the French fries, but with small enough apertures that the French fries cannot fall out. Apertures 94 are preferably round and 9.5 mm in diameter and are placed in a nested pattern. Any pattern or shape of apertures may be used to provide the desired open area.

Since container 80 is preferably made of thin metal foil, openable top end 91 may either be permanently open or closable and openable. Openable top end 91 is located within toaster slot 28 when heating occurs. Electrically non-conducting lifting tab 86 is preferably made of paper and is connected to container 80 by staple, crimp, or other attachment means. Lifting tab 86 preferably extends well above the vertical slot of a conventional toaster so that it is cool-to-the-touch during and after heating in the toaster.

Closed bottom 88 of container 80 is preferably folded so that container 80 may be made of a single sheet of material and yet accommodate the thickness of the single layer of French fries placed in the container. Closed bottom 88 preferably forms a drip trough 100 into which the drippings may accumulate. Located in drip trough 100 of closed bottom 88 is preferably a fluid-absorbent member 102, which is made of a material which will absorb drippings while supporting French fries 92 so that drippings are effectively separated from the French fries.

In a particularly preferred embodiment of the present invention, French fries 22, 52, and 92 have an average length of 76 mm to 102 mm, an average thickness of 6 mm and an average width of 6 mm. Although the aperture size of 9.5 mm diameter is large enough for a 6 mm by 6 mm cross-section to pass through, the ability to angle a French fry relative to the plane of an aperture within the container is limited; thus, this aperture size and shape effectively prevents French fries falling out of the container, as determined empirically. Typically, a container 40 will hold 18 French fries stacked upright, side-by-side in a single layer. Container 40 has outer dimensions of 152 mm height, 124 mm width, and 7 mm thickness. Dimensions A and B or C and D are preferably 12 mm and 12 mm, respectively. Aperture open area in the front and back of the container between solid band of material and the non-apertured drip trough preferably ranges from about 50% to about 75%.

Fluid-absorbing members 32, 62, and 102 may be hydrophilic and/or lipophilic materials selected from the group consisting of fibers, foams, gels, and combinations thereof. For French fries, fluid-absorbing member 62 preferably has dimensions of 6 mm by 110 mm. Fluid absorbing member 62 is preferably made of open-celled polymeric foam of the type described in U.S. Pat. No. 5,260,345 to DesMarais et at., entitled "ABSORBENT FOAM MATERIALS FOR AQUEOUS BODY FLUIDS AND ABSORBENT ARTICLES CONTAINING SUCH MATERIALS", which issued on Nov. 9, 1993, and which is hereby incorporated by reference.

The time for toasting frozen French fries typically ranges from about 1.5 minutes to about 2.5 minutes. Overheating container 40 is not a problem, since it is made of metal that melts at nearly double the temperature of a conventional toaster heating temperature. It is believed that fluid-absorbing member 62 experiences much less of that heat because it is located near the bottom of the toaster.

Reheated prior art frozen French fries generally lack the desirable surface crispness associated with high-quality deep-fried French fries because the frozen fries are par-fried to relatively high moisture contents (e.g.>50% bulk moisture) prior to freezing. The limited amount of frying to yield a relatively high-moisture parfry results, upon toaster heating, in a fry that lacks a crust structure typical of deep-fried French fries. One approach for producing a crust in a toaster heated fry that more closely simulates that of deep-fried French fries is to parfry the potato strips more extensively to a lower moisture content (e.g.<50% bulk moisture) so as to more fully develop the crust structure and thickness. While this approach may yield improved surface crispness upon toaster heating of the parfries, it also remits in a significant driving force for moisture migration during frozen storage. The thicker, more developed low-moisture crust region of the resulting parfry has a relatively low water activity (Aw) and will, therefore, tend to act as a sink for the movement of water vapor away from the internal core of the parfry during frozen storage. Consequently, there is a potential that with an extended time of frozen storage (and/or fluctuating temperatures) the internal core of the fry will be dehydrated to such an extent that the toaster heated French fry will be perceived as having an unacceptably dry interior.

Moisture conditioning of par-fried potato strips, upon oven-finishing, yield deep fried internal and surface textural properties. It has been found that toaster heated French fries that have substantially the same internal and surface texture as deep fried French Fries can be produced by reducing the amount of moisture transfer that occurs between the high-moisture internal starch matrix and the low-moisture crust region during frozen storage. This reduction in moisture transfer is accomplished by hydrating the outer surface of par-fried potato strips prior to frozen storage. As a result of this surface hydration step, parfried potato strips can be produced that have been fried more extensively to lower moisture contents (i.e.<50% moisture) to more fully develop the crust structure, and yet which are not subject to significant water movement from the fry interior to the crust region during frozen storage. The surface hydration step effectively increases the water activity of the outer crust region, thereby, greatly reducing or eliminating the water activity differential between the fry interior and crust region that is the drying force for moisture migration. Upon toaster heating, these hydrated parfries have a surface texture more like deep-fried French fries because they have been parfried more extensively to develop the crust structure. In addition, the toaster heated fries have a desirable moist interior because the surface hydration step has minimized dehydration of the core during frozen storage. Net, the toaster heated French fries of the present invention possess both internal and surface textural attributes that closely simulate deep-fried French fries.

A particularly preferred process for preparing par-fried potato strips which, when toaster heated, have substantially the same crispness and internal textural attributes of French fried potatoes that have been finished by deep frying comprises the steps of:

(a) parfrying potato strips at an oil temperature of from about 270° F. (132° C.) to about 385° F. (196° C.) for a time sufficient to reduce the moisture content of the par-fries to from about 50% to about 30%; (b) hydrating the surface of the par-fries by application of water or an aqueous solution or dispersion until the weight thereof is increased by from about 1% to about 12%; and (c) freezing the hydrated par-fries. The resulting frozen hydrated par-fries have a bulk moisture of from about 35% to about 55% moisture by weight.

While particular embodiments of the present invention have been illustrated and described, it will be obvious to those skilled in the art that various changes and modifications may be made without departing from the spirit and scope of the invention, and it is intended to cover in the appended claims all such modifications that are within the scope of the invention.

What is claimed is:

1. A container for heating frozen French fries in a toaster, said container comprising an upright structure and frozen French fries therein, said upright structure adapted to removably fit into a vertical slot of a conventional toasters and be supported by said toaster during a toaster heating cycle, said upright structure having a front and back connected to a closed bottom, said front and back having side edges said front and back also having apertures therethrough for passing heat from said toaster to said frozen French fries located inside said upright structure and for passing steam from heated French fries to outside of said upright structure, said upright structure having an openable end to permit removal of said heated French fries, said frozen French fries being oriented upright and side-by-side in said upright structure said frozen French fries having uppermost and lowermost ends and said closed bottom forming a drip trough for collecting drippings from said lowermost ends of said heated French fries, said drip trough protecting said lowermost ends of said French fries from direct radiation from said toaster and said uppermost ends of said French fries being protected from direct radiation from said toaster by a solid band of material in said front and said back of said upright structure at a location covering substantially all of said uppermost ends of said French fries, said apertures being sized small enough that said frozen French fries and said heated French fries cannot escape from said upright structure through said apertures.

2. The container of claim 1 wherein said apertures provide an open area in said front and said back between said solid band of material and said drip trough, said open area ranging from about 50% to about 75%.

3. The container of claim 1 wherein said Frozen French fries have a moisture content ranging from 35% to 55% prior to heating in said toaster so that after heating, heated French fries have substantially the same internal and surface texture as deep fried French fries.

4. The container of claim 1 wherein said upright structure is mechanically held together without adhesive such that mechanical fastening provides adequate strength for handling but is weak enough that said container is easily openable.

5. The container of claim 1 further comprising a fluid absorbent member fixedly attached to said drip trough.

6. The container of claim 1 further comprising a handle portion extending above a toaster slot when said container is supported in said slot so that said handle portion is cool-to-the-touch during and after heating, and said handle is electrically non-conductive to reduce the potential for electrical shock when removing said container from said slot.

7. The container of claim 6 wherein said handle portion is a lifting tab made of paper and is attached to said container.

8. The container of claim 6 wherein said handle portion is an extension of said container, said handle portion having apertures to limit heat conduction and having an external coating of an electrically non-conductive material.

* * * * *